US005170922A

United States Patent [19]

Ehmig et al.

[11] Patent Number: 5,170,922

[45] Date of Patent: Dec. 15, 1992

[54] POWDER CHARGE OPERATED SETTING TOOL

[75] Inventors: Gerhard Ehmig, Rankweil, Austria; Uwe Hilmert, Sevelen, Switzerland; Peter Jochum, Meiningen, Austria; Markus Frommelt, Schaan, Liechtenstein

[73] Assignee: Hilti Aktiengesellschaft, Liechtenstein

[21] Appl. No.: 731,505

[22] Filed: Jul. 17, 1991

[30] Foreign Application Priority Data

Jul. 17, 1990 [DE] Fed. Rep. of Germany ..... 4022674

[51] Int. Cl.[5] ..... B25C 1/14

[52] U.S. Cl. ..... 227/8; 227/10

[58] Field of Search ..... 227/9, 10, 11, 8

[56] References Cited

U.S. PATENT DOCUMENTS 3,409,504 9/1969 Neighorn ..... 227/10 X
3,469,757 9/1969 Kvavle et al. ..... 227/10 X
4,114,792 9/1978 Pomeroy ..... 227/10 X
4,364,506 12/1982 Schneider ..... 227/10
4,493,376 1/1985 Kopf ..... 227/9 X

*Primary Examiner*—Frank T. Yost
*Assistant Examiner*—Rinaldi Rada
*Attorney, Agent, or Firm*—Anderson Kill Olick & Oshinsky

[57] ABSTRACT

Powder charge operated setting tool includes a barrel (11) and a closing or breech member (17), axially displaceable within a housing 1. Stops (3a, 17a) and shoulders (8b, 11e) cooperating with each other are provided in the housing (1) and on the barrel (11) as well as on the closing member (17) which limit displacement of the barrel (11) and, after an additional displacement travel, the displacement of the closing member (17) counter to the setting direction. As a result a free space is formed between the barrel (11) and the closing member (17) which permits feeding of propellant charges (15), especially in magazines, perpendicularly to the axis of the barrel.

9 Claims, 7 Drawing Sheets

POWDER CHARGE OPERATED SETTING TOOL

The invention is directed to an explosive powder charge operated setting tool having a housing in which a barrel and a closing or breech member are axially displaceable. Stops limiting the displacement travel of the breech member opposite to the setting direction are provided within the housing on the one hand and on the closing member on the other hand, and the closing member abuts against the housing via a pressure spring acting in setting direction and the barrel has a chamber for the propellant charge.

A powder charge operated setting tool is disclosed in DE PS 16 03 843 for reducing the recoil forces which have a disadvantageous effect upon material stresses and operating personnel, in which a barrel and a breech member are displaceably located in the housing. Due to this displaceable arrangement of the barrel and breech member in the housing the result concerning the recoil forces is only achieved with other disadvantages. These other disadvantages lie especially in the design structure. Thus, it is not possible to feed propellant charges in a reliable manner perpendicularly to the barrel axis into a chamer in the barrel. In this tool the barrel is pivoted relative to the breech member around a bearing or support bolt located eccentrically and parallel to the axis of the barrel for feeding a propellant charge to the chamber, wherein the front of the barrel together with the chamber for the propellant charge is exposed for feeding the propellant charge. This solution, which is disadvantageous as far as handling and design effort are concerned, additionally does not permit charging the tool with propellant charges from a magazine strip or belt.

This known tool has not found wide acceptance, because of the above named disadvantages, though it is advantageous as far as the avoidance of recoil forces is concerned and in addition opening up possibilities for utilizing the displacement of the breech member initiated by the generated gas pressure for other functions, for instance, for the supply of propellant charges.

SUMMARY OF THE INVENTION

Therefore, the primary object of the invention is to provide a powder charge operated setting tool, capable of reducing recoil forces, and additionally enabling a simple supply in a conventional manner of propellant charges perpendicularly to the axis of the barrel in magazine strips.

In accordance with the present invention, shoulders are provided for limiting the displacement travel of the barrel counter to the setting direction at the housing on the one hand and the breech member on the other hand, wherein, in the abutting position of the breech member and barrel, the distance between the stop and the shoulder at the housing measured along the displacement direction is greater than the correspondingly measured distance between the stop at the breech member and the shoulder at the barrel.

Due to the gas pressure generated after the propellant charge is ignited, the barrel and the breech member move in the housing counter to the setting direction. Because of the arrangement of the stops and shoulders according to the invention, the shoulders between the barrel and the housing run-up earlier against each other than the shoulders between the breech member and the housing. As a result the breech member continues to move counter to the setting direction while the barrel has ceased to move, whereby a free space is formed between the barrel and the closing member and thus the chamber for the propellant charge is opened. The free space formed permits the feeding of propellant charges to the chamber perpendicularly to the axis of the barrel. This applies to individual charges as well as to charges held in magazines, for instance in a known carrier strip. Accordingly, the difference of the spacing in the invention is selected to be larger than the length of the propellant charge plus a possible portion of the carrier strip projecting beyond the propellant charge in the axial or setting direction.

A carrier strip of a known type can be retained in a guidance channel in the breech member, whereby an expended propellant charge is pulled out of the receptacle through continuous displacement of the breech member relative to the barrel counter to the setting direction.

Preferably, a conveying rocker, in engagement with a carrier strip containing propellant charges, is arranged at the housing. After a propellant charge has been ignited, the carrier strip with the breech member moves counter to the setting direction. The carrier strip is offset with respect to the conveying rocker and is, for instance, moved ahead by one conveying step during backward displacement relative to the setting direction. When the conveyance strip is moved counter to the setting direction, the conveying rocker moves, in order to grip again for the next conveying step.

The conveying rocker is expediently formed as a pivot lever rotatably supported in the housing and having a control or support curve for the carrier strip. The pivot lever can be supported in the housing at its end facing away from the control curve so it is rotatably supported around an axis extending at right angles to the longitudinal extent of the pivot lever and can be held with the control curve against the carrier strip by means of spring pressure. The control curve can cooperate with recesses in the edges of the carrier strip, for instance, in such a way that when displacing the control strip counter to the setting direction the pivot lever with the control curve is displaced out of one recess and, when displaced in the opposite direction, it engages into the next recess. The control curve can be formed by a ledge-shaped rise or elevation, which is profiled in a manner known as such depending upon the cross section of the recesses in the carrier strip.

Feeding propellant charges perpendicularly to the barrel axis is advantageously facilitated by providing a blocking arrangement engageable when the stops at the housing and at the breech member run up against each other thus acting counter to displacement of the breech member in setting direction. The blocking arrangement maintains the breech member in a position displaced opposite to the setting direction until it is disengaged, whereby the free space formed after stopping of the barrel by continued displacement of the breech member counter to the setting direction is maintained, until the blocking arrangement is again disengaged.

Preferably, the blocking arrangement is supported in the housing and has an abutment shoulder for the breech member. Location of the blocking arrangement of the housing is advantageous as far as motion technology and function are concerned, since the blocking arrangement has merely to perform an engagement and disengagement motion with respect to the housing, which is considered to be a stationary part. For instance, the blocking arrangement can be formed as a one arm pivoting lever. The abutment shoulder can catch the breech member in the position displaced opposite to the setting direction.

Preferably, a spring element serving for engaging the blocking arrangement is provided. The spring element causes an automatic engagement of the blocking arrangement, as soon as the breech member arrives into the effective range of the abutment shoulder of the blocking arrangement.

An actuation part serving for the disengagement of the blocking arrangement is expediently provided. The actuation part is advantageously formed as a control curve cooperating with the barrel during displacement of the barrel in the setting direction. The barrel comprises a control cam, which engages at the control curve towards the end of the travel of the barrel in the end position in the setting direction for disengagement of the blocking arrangement. This creates an additional enlargement of the free space between the breech member and the barrel. This is particularly advantageous if the displacement of the closing member in the setting direction occurring after disengagement of the blocking device is utilized for conveying a carrier strip extending perpendicularly to the axis of the barrel.

The disengagement of the blocking arrangement by displacing the barrel in the setting direction preferably occurs automatically by means of a spring abutting in the housing and displacing the barrel in the setting direction.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
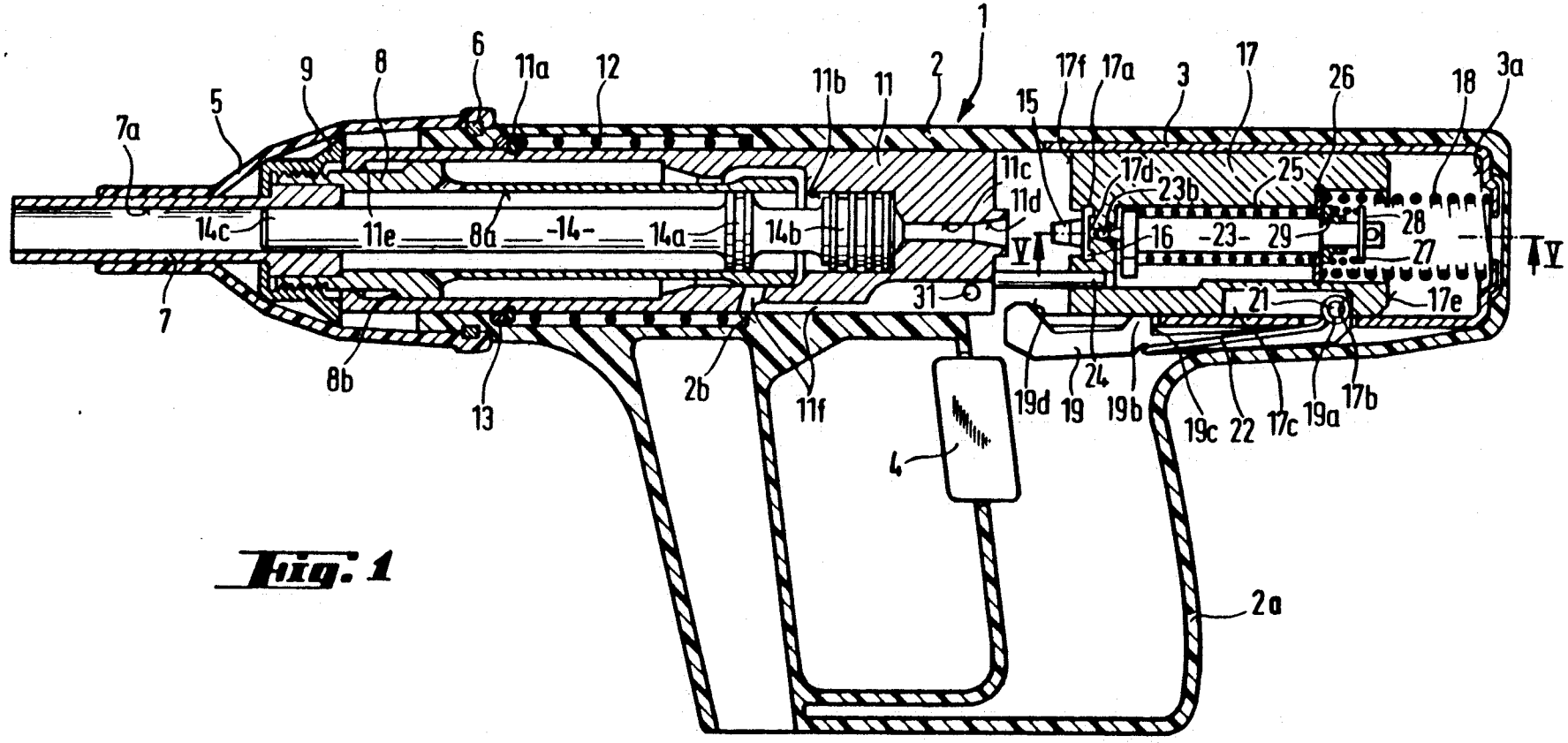
FIG. 1 is a powder charge operated setting tool in axial section and shown in a neutral position.

The setting tool comprises a housing 1 with a plastic shell 2 and a tubular shaped guidance member 3 inserted into the shell. The plastic shell 2 has an outwardly extending handle 2a in which a trigger 4 of a known tripping device, not shown, is arranged; this is shown by way of an indication only. A protective cap 5 is fitted at the leading end of the plastic shell 2, and is fixed by a retaining ring 6.

A muzzle part 7 is fitted in the leading end of the tool and can be pressed against the receiving material U. The muzzle part is displaceable through the protective cap 5 opposite to the setting direction. The muzzle part 7 is seated at its trailing end in a guide tube 8 and is detachably fixed by means of a clamping nut 9 at the guide tube 8. Muzzle part 7, guide tube 8 and clamping nut 9 are displaceable together relative to the housing 1.

The guide tube 8 is laterally enclosed by a barrel 11. The barrel 11 extends rearwardly from the guidance tube 8. A spring 12, laterally surrounding the barrel 11, abuts at its trailing end against a support shoulder 2b of the plastic shell 2 and abuts at its leading end against a support disk 11a of the barrel 11. The barrel 11 is pressed according to FIG. 1, in the neutral position together with the support disk 11a against a stop ring 13 supported in the housing. The barrel 11 drives the muzzle part 7 and the guide tube 8 in the setting direction through the clamping nut 9 by means of its front face pointing in setting direction. A driving piston 14 with a radially enlarged annular section 14a and a radially enlarged head 14b is displaceably supported in bore 8a of the guide tube 8 and in the bore 11b of the barrel 11. A shank 14c extends in the setting direction and has a smaller diameter than the annular segment 14a and the head 14b. The shank 14c penetrates a muzzle bore 7a in the muzzle part 7. A channel 11c follows counter to the setting direction upon the bore of the barrel 11b, into which discharges a chamber 11d for a propellant charge 15 mounted in a carrier strip 16.

A closing or breech member 17 is displaceably supported in the guidance member 3 of the housing 1 behind the barrel 11. The carrier strip 16 with propellant charges is mounted therein and sits in a guidance channel 17a in the breech member 17. The carrier strip 16 with the propellant charges 15 is displaceable perpendicularly to the barrel axis through the guidance channel 17a. The breech member 17 is urged by a pressure spring 18 in setting direction and bears against, in the off position of the setting tool shown in FIG. 1, a bearing sleeve 19a of a pivotal blocking arrangement 19 by means of a backside 17b of a window-like recess 17c. The bearing sleeve 19a is supported on a bearing bolt 21 fixedly seated in the housing.

The blocking device 19 is formed as a single arm pivot lever that comprises a support lug 19b directed towards the clockwise pivoting movement by means of which lug the blocking device 19 abuts in the off-position of the setting tool against the circumferential surface of the breech member 17. The support lug 19b forms a support shoulder 19c facing opposite to the setting direction. The free or leading end of the blocking arrangement 19 is widened in a head-like manner and comprises an actuating part 19d in the form of a control curve or surface. A spring element 22 attached to the bearing bolt 21 biases the blocking device 19 clockwise and thereby holds the support lug 19b against the breech member 17.

A firing pin 23 is displaceably supported in the breech member 17. This firing pin comprises at the front or leading end a laterally projecting entrainment cam 23a. The entrainment cam 23a protrudes into the axial projection of an entrainment bolt 24 projecting from the barrel 11 opposite to the setting direction and extending into the breech member 17. A firing tip 23*b* projects in setting direction at and projects into a through aperture 17*d* in the breech member 17. A tension spring 25 encircling the firing pin abuts at a support disk 26 in the trailing portion of the breech member 17 and urges the firing pin 23 in the setting direction. A pullback or return spring 27 sits near the trailing end of the firing pin 23, and bears against the firing pin 23 by means of a disk 28. At its leading end, spring 27 bears at a support ring 29.

Figure 2:
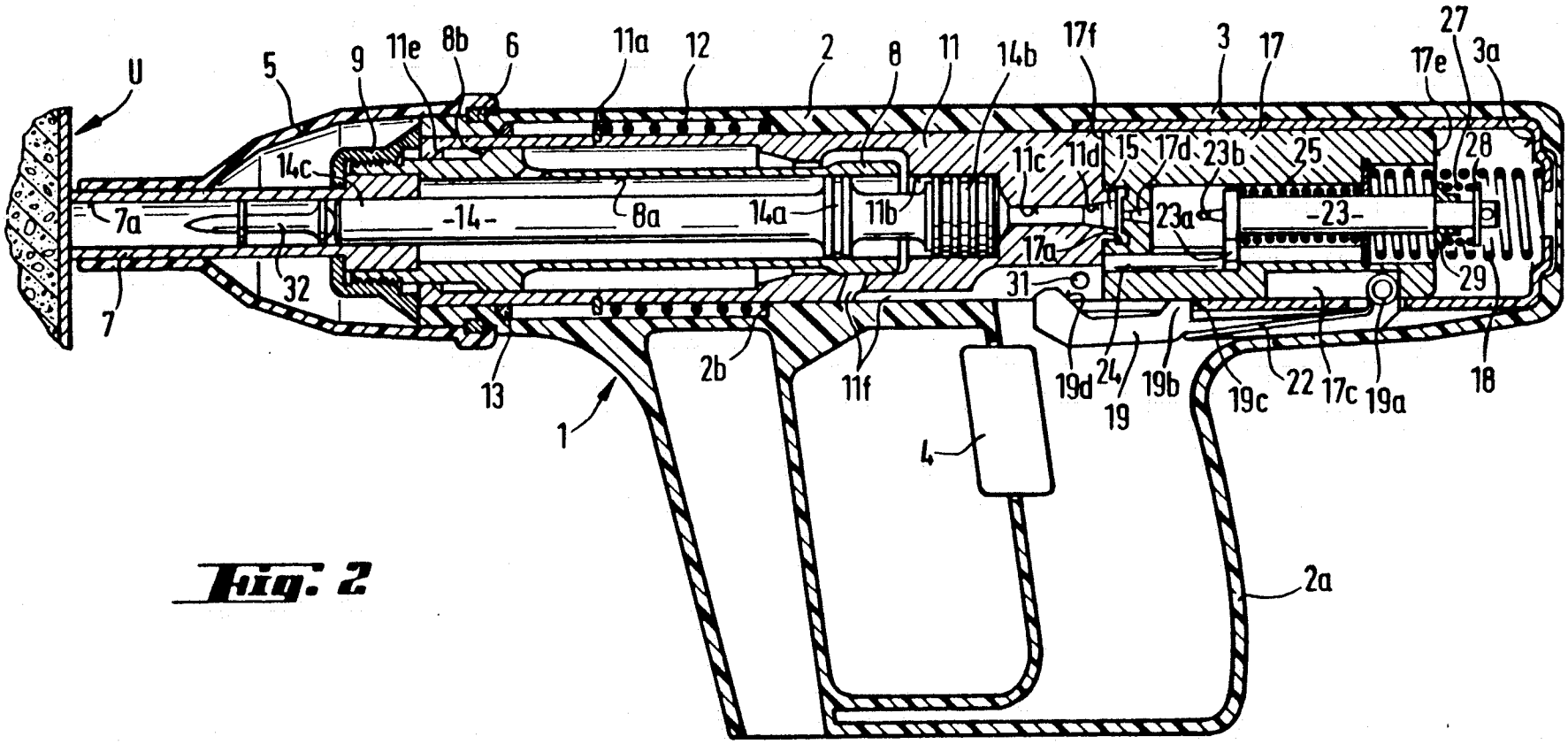
FIG. 2 is the setting tool in FIG. 1 pressed against the receiving material and shown in the ready to fire position.

In order to achieve the ready to fire position shown in FIG. 2, the setting tool is pressed with its muzzle part 7 against the receiving material U. Thereby the muzzle part 7 moves opposite to the setting direction and carries with it on the one hand the guide tube 8, and on the other hand the barrel 11. The entrainment bolt 24 engages at the entrainment cam 23*a* and thus moves the firing pin 23 rearwardly against the force of the tension spring 25. The trailing end of the barrel 11 then impacts against the breech member 17. Because of the displacement of the barrel 11 counter to the setting direction, the spring 12 is also tensioned.

As can be seen by comparing FIG. 1 and FIG. 2, a control cam 31 projecting laterally from the barrel 11 near its trailing end moves past the leading end of the blocking device 19 formed by the actuation part 19*d*, when the barrel 11 is moved into the pressed-in ready to fire position.

Figure 3:
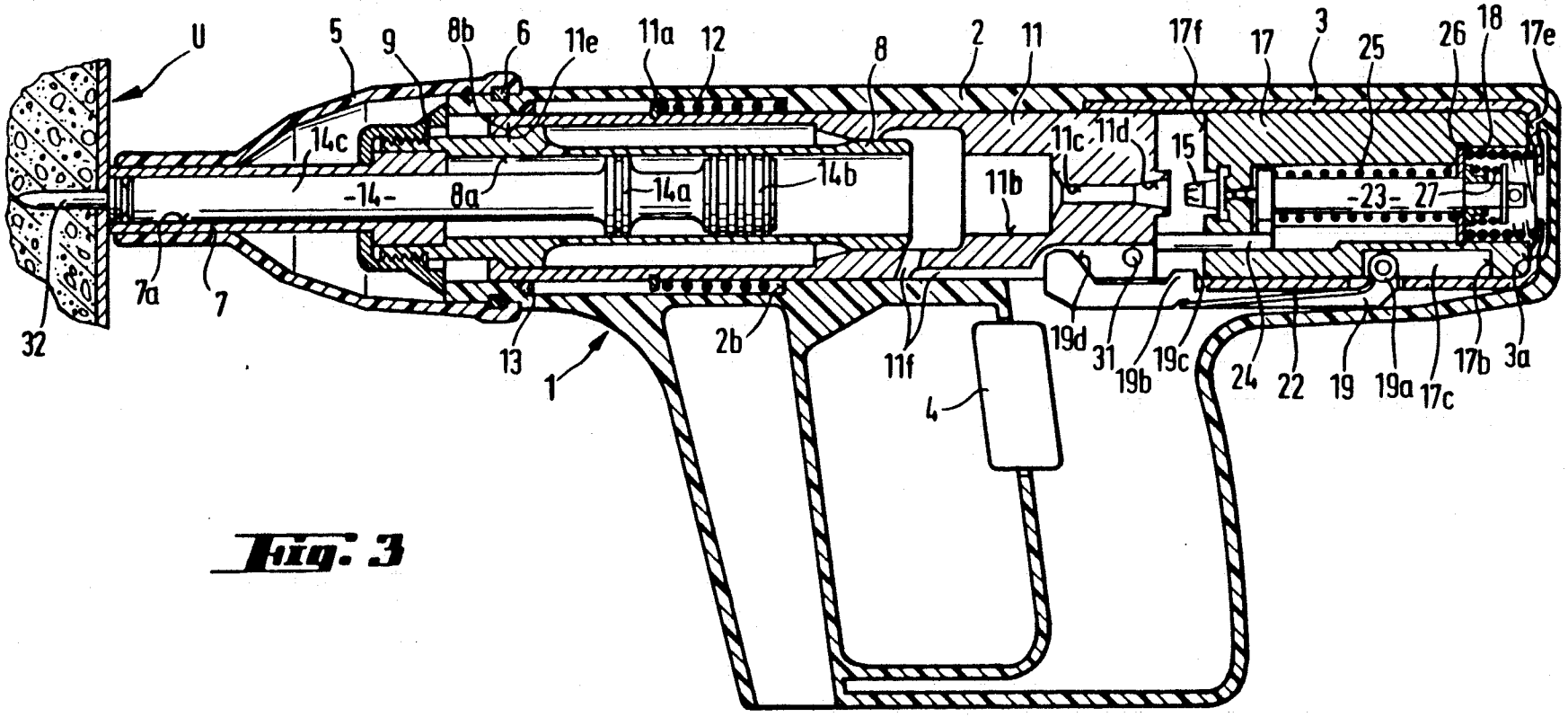
FIG. 3 is the setting tool in FIG. 1 in the course of the setting process, after the propellant charge has been ignited.

Because of the subsequent release of the firing pin 23, preferably by turning the firing pin 23 so that the entrainment cam 23*a* moves out of the axial projection of the entrainment bolt 24, the propellant charge 15 within the chamber 11*d* is ignited. The gas pressure generated acts upon the driving piston 14. The piston is accelerated in the setting direction for driving a fastening element 32 out of the muzzle bore 7*a* into the receiving material U, as is shown in FIG. 3. The gas pressure, however, generates forces acting counter to the setting direction upon the barrel 11 and the breech member 17, so that these parts move, relative to the housing 1, counter to the setting direction. The barrel 11 moves herein until a shoulder 11*e* adjacent its leading end impacts against a shoulder 8*b* on the guide tube 8 stationary relative to the housing 1 (FIG. 3). The breech member 17 continues to travel counter to the setting direction and pulls the expended propellant charge 15 out of the chamber 11*d*. The breech member 17 impacts with its rear or trailing end face, serving as stop 17*e*, against the inner forwardly directed face of the guidance member 3 acting as stop 3*a* at the trailing end of the housing. Shortly prior to achieving this stopped position of the breech member 17, its leading end face 17*f* arrives behind the support shoulder 19*c*, whereby the blocking device with the support lug 19*b* pivots in front of the breech member 17.

Pivoting occurs automatically by the biasing action of the spring element 22, as is shown in FIG. 3.

Figure 4:
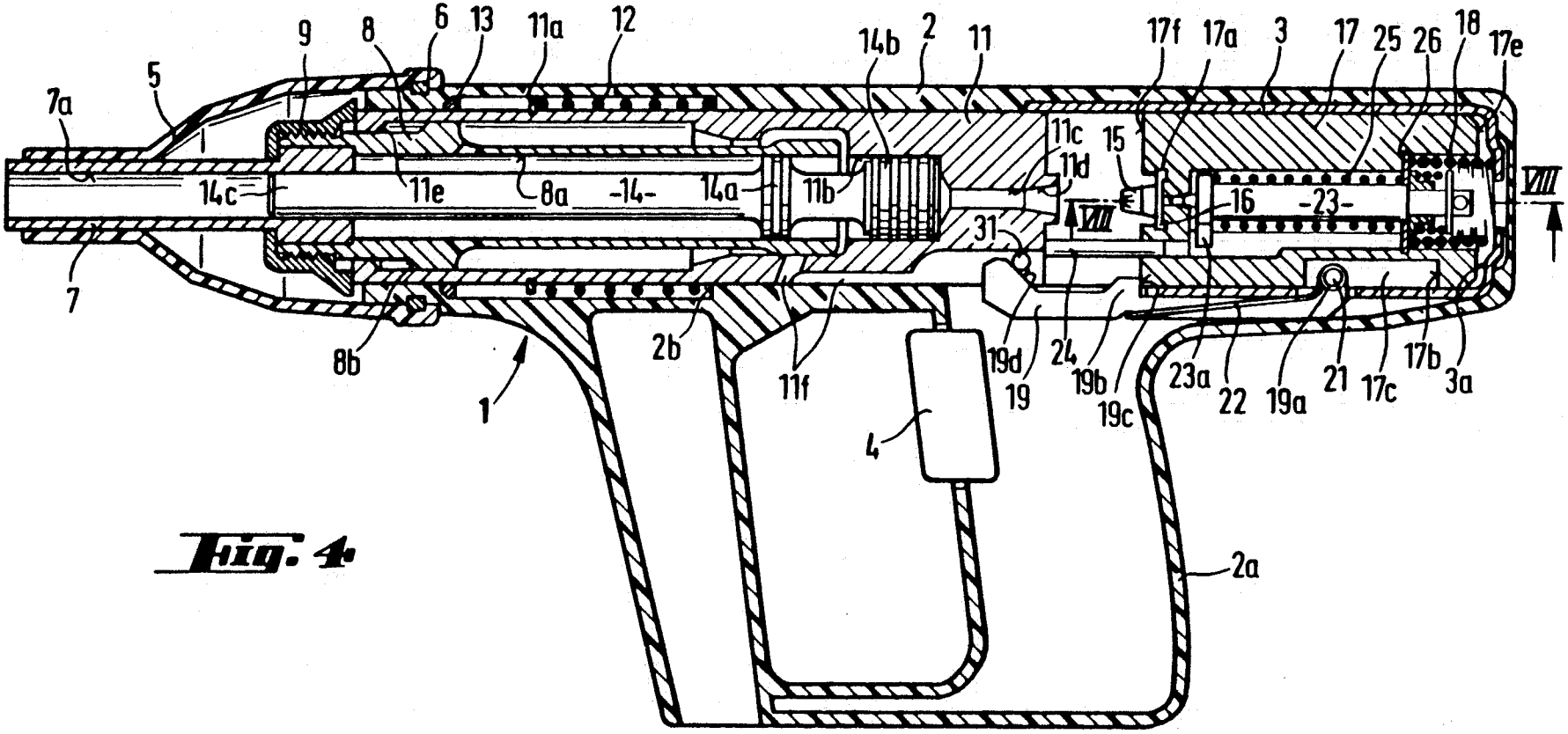
FIG. 4 is the setting tool in FIG. 1 during the return of the barrel in the setting direction.

Directly after driving the fastening element 32 e.g. note FIG. 2, the driving piston 14 is urged opposite to the setting direction into the initial position by directing a portion of the driving gases into the bore 8*a* of the guide tube 8. Herein a space located behind the head 14*b* is vented through a channel 11*f*, FIG. 3. Simultaneously the tensioned pressure spring 18 drives the breech member 17 with its leading end face 17*f* against the inwardly pivoted support shoulder 19*c*, as shown in FIG. 4. Accordingly, the breech member 17 is prevented from moving in the setting direction, until the blocking arrangement 19 is pivoted counterclockwise.

The setting tool is lifted off the receiving material U after driving the fastening element 32, whereupon the barrel 11 is moved by the spring 12 in setting direction and also moves the muzzle part 7 and the guide tube 8 along with it. A corresponding free space is formed between the trailing end of the barrel 11 and the leading end of the breech member 17 for the supply of a new propellant charge 15 perpendicularly to the barrel axis. After this free space is formed, the control cam 31 runs against the actuating part 19*d* and pivots the blocking device 19 counterclockwise with additional displacement of the barrel 11 in setting direction. The support shoulder 19*c*, as a consequence, exposes the leading end face 17*f*, so that the breech member 17 can be urged by the pressure spring 18 into the neutral position shown in from FIG. 1. The barrel 11 in the meantime assumes the neutral position illustrated in FIG. 1, wherein the control cam 31 travels in setting direction forwardly of the leading front end of the blocking device 19.

Figure 5:
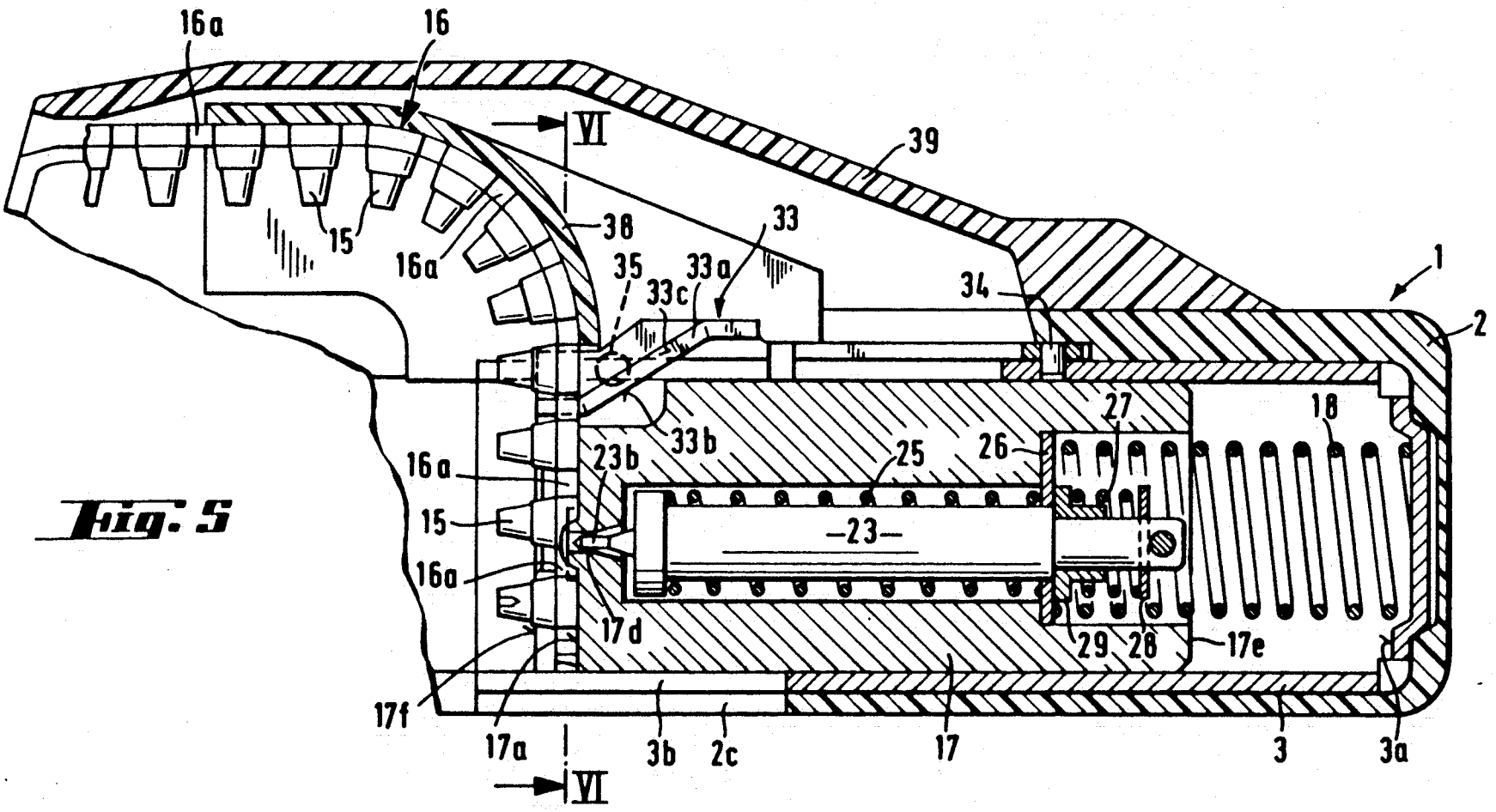
FIG. 5 is a sectional view of the setting tool, taken along the sectional line V—V in FIG. 1 and illustrated on an enlarged scale.
Figure 6:
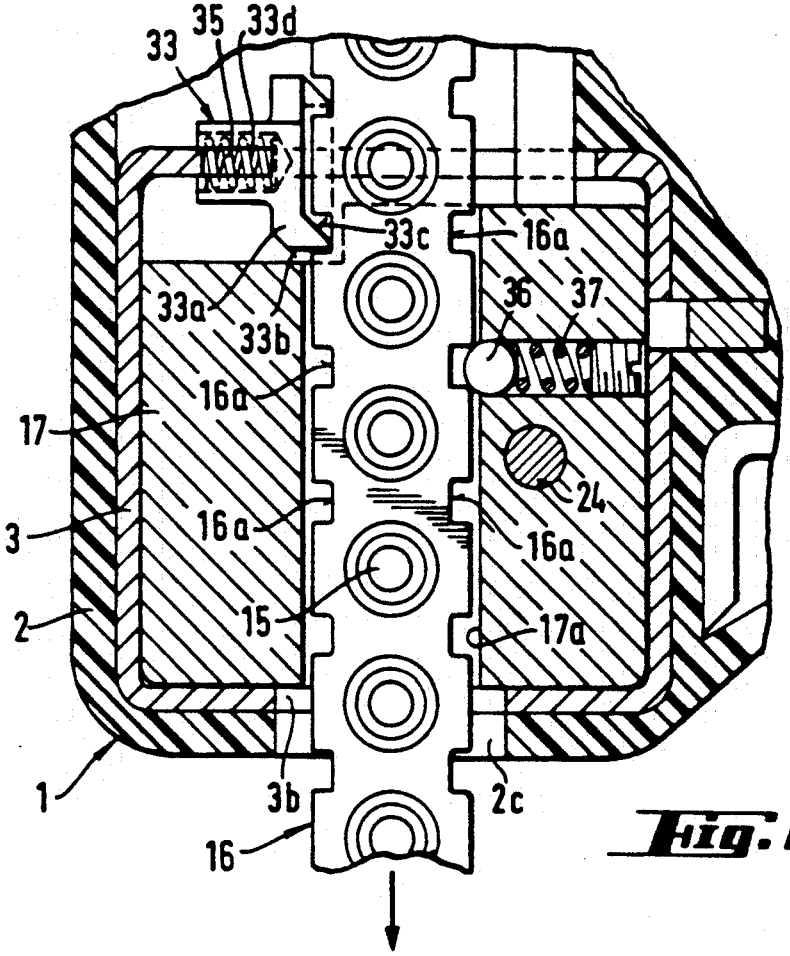
FIG. 6 is a sectional view of the setting tool, taken along the sectional line VI—VI in FIG. 5.

As shown best in FIGS. 5–8 the carrier strip 16 comprises rectangular recesses 16*a* in its edge regions. A control curve 33*a* engages into the recesses 16*a*, which curve is arranged at a conveying rocker 33 in the shape of a ridge shaped end. As FIGS. 6 and 7 clarify the control curve 33*a* has essentially a saw-tooth shape in cross section, whose steep flank 33*b* points in conveying direction and whose less steep flank 33*c* points counter to the conveying direction. The conveying rocker 33 is formed as a pivoting lever and is rotatably supported by a bolt 34 mounted in the guidance member 3. The pressure spring 35 bearing against the guidance member 3 urges the conveying rocker 33 with the control curve 33*a* against one end region of the carrier strip 16. The conveying rocker 33 comprises a guide groove 33*d* for side guidance, into which projects the guidance member 3 (FIG. 6). A snap-in device with a ball 36 and a helical spring 37 holds, after a completed conveying step, the carrier strip 16 in position with engagement of the ball 36 into one of the recesses 16*a*, as shown in FIG. 6.

Figure 7:
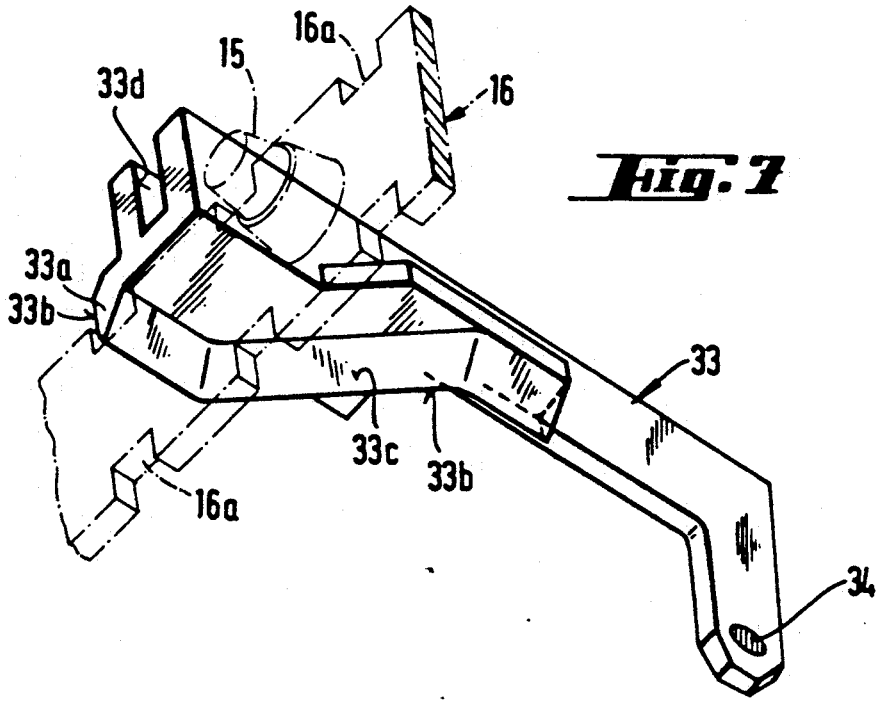
FIG. 7 is an enlarged perspective view of the conveying rocker.
Figure 8:
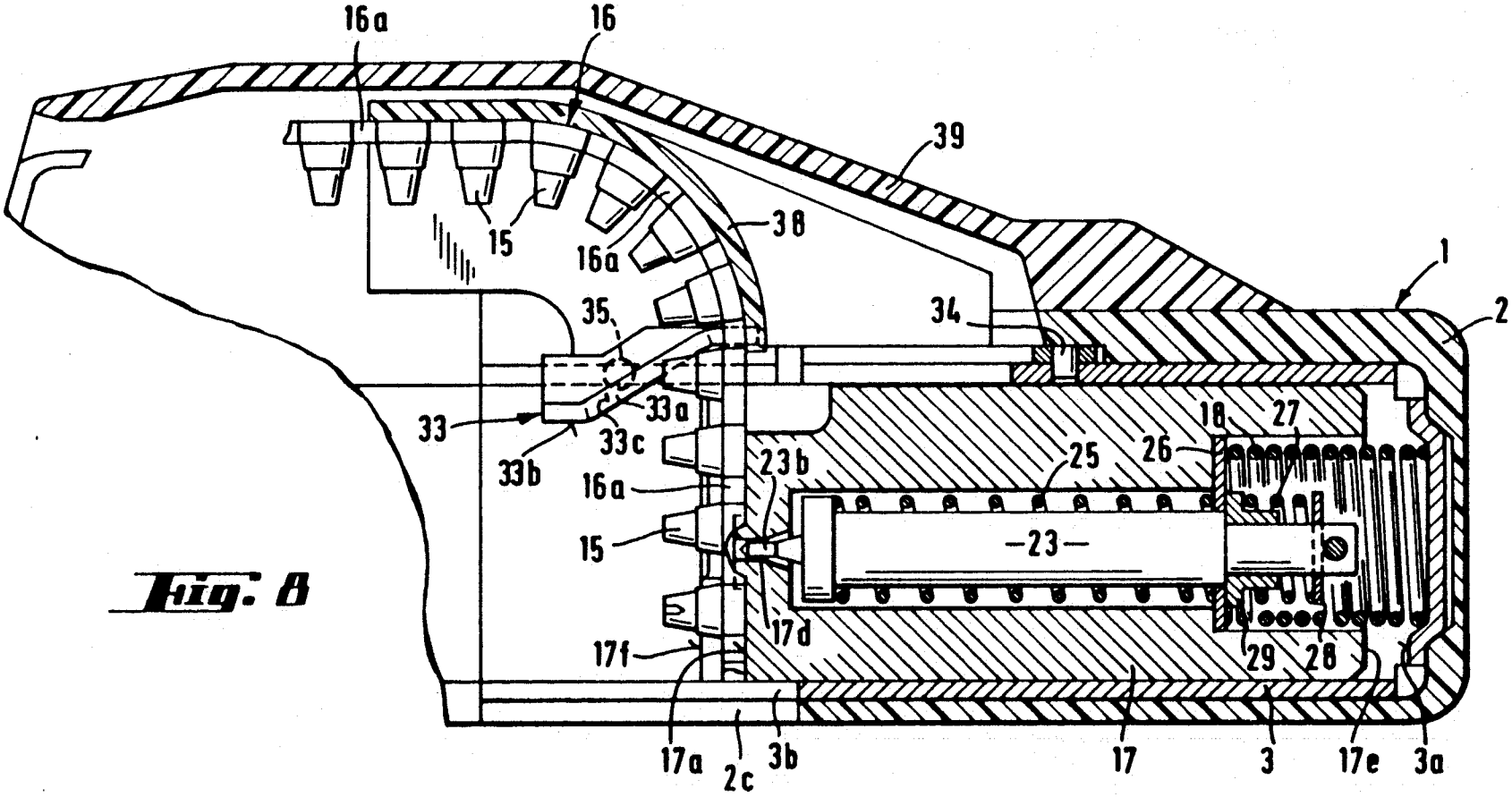
FIG. 8 is a sectional view of the setting tool, taken along the sectional line VIII—VIII in FIG. 4 on an enlarged scale.

In the neutral position of the tool the control curve 33*a* engages into one of the recesses 16*a* of the carrier strip 16, as this can be seen in FIGS. 5–7. After firing the propellant charge 15 located in line with the firing bolt 23, the closing or breech member 17 is moved by the gas pressure counter to the setting direction as previously explained and carries the carrier strip 16 with the propellant charges 15 along with it. This displacement movement leads to the control curve 33*a* moving out of the recesses 16*a* by the sides of the recess 16*a* urging the control curve 33*a* by means of the less steep flank 33*c* biasing the control curve 33*a* outwardly against the force of the pressure spring 35. As a result the carrier strip 16 arrives with a following recess 16*a* above the section of the control curve 33*a* facing away from the setting direction, so that the control curve 33*a* can be engaged by the pressure spring 35 into the next recess 16*a* (FIG. 8).

When the setting tool is lifted off the receiving material U, the breech member 17 moves in the setting direction, and the steep flank 33*b*, through engagement into the recess 16*a*, causes a displacement of the carrier strip 16 by one conveying step. The ball 36 of the snap-in device releases the carrier strip 16 so that it snaps into the next recess 16*a* after completion of the conveyance step. The expended propellant charge 15 is conveyed away and a new propellant charge arrives in the effective range of the firing bolt 23.

Since the conveyance of a respectively next propellant charge 15 occurs only after previous ignition of a propellant charge 15, it is assured that no unignited propellant charge 15 is conveyed and can exit from the setting tool. Two passages 2*c*, 3*b* are provided in the plastic shell 2 and in the guidance member 3 for the exit of the carrier strip 16 with the expended propellant charges 15. Carrier strip 16 with the propellant charges 15 is directed to the guide channel 17*a* by means of a guide rail 38 connected with the breech member 17. The guide channel 17*a* and the carrier strip 16 are covered externally by a protective shield 39 fixed at the housing 1.

While specific embodiments of the invention have been shown and described in detail to illustrate the application of the inventive principles, it will be understood that the invention may be embodied otherwise without departing from such principles.

We claim:

1. Powder charge operated setting tool comprising a housing (1) having a leading end and a trailing end spaced apart in a setting direction of the setting tool, an axially extending barrel (11) axially displaceably mounted in said housing (1), a breech member (17) axially displaceably mounted in the trailing end of said housing rearwardly of said barrel, a stationary stop (3*a*) at the trailing end of the housing (1) and a displaceable stop (17*e*) at a trailing end of said breech member (17), the stationary stop (3*a*) and the displaceable stop (17*e*) limit the displacement of the breech member (17) counter to the setting direction of the setting tool, a pressure spring (18) located within said housing (1) and biasing the breech member (17) in the setting direction, and the barrel (11) comprising a chamber (11*b*) at a trailing end thereof for receiving a propellant charge (15), wherein the improvement comprises an axially extending guide tube having a leading end and a trailing end axially displaceably mounted in the setting direction within said housing, a first shoulder (8*b*) on said guide tube (8) adjacent the leading end thereof, a second shoulder (11*e*) on the leading end of said barrel (11) adjacent the leading end thereof and facing said guide tube shoulder (8*b*), said first shoulder (8*b*) and second shoulder (11*e*) limit displacement of the barrel counter to the setting direction after a trailing end of said barrel (11) contacts a leading end of the breech member (17) and the breech member continues to move counter to the setting direction, the distance in the setting direction between the stationary stop (3*a*) and the first shoulder (8*b*) in the housing is greater than a corresponding distance between the displaceable stop (17*e*) and the second shoulder (11*e*) on the barrel when the barrel (1) and the breech member (17) are in spaced relation in a neutral position.

2. Setting tool according to claim 1, wherein a conveying rocker (33) is pivotally mounted in the housing (1) and is engageable with a carrier strip (16) containing propellant charges (15) for moving the propellant charges into said chamber (11*d*).

3. Setting tool according to claim 2, wherein the conveying rocker (33) is formed as a pivot lever with a control curve (33*a*) for engaging recesses (16*a*) in the carrier strip (16) and moving the carrier strip in a stepwise manner.

4. Setting tool according to one of the claims 1, 2 or 3, wherein a blocking device (19) is located in said housing (1) and is selectively engageable with said breech member (17) and acts counter to displacement of the breech member (17) in the setting direction upon impact of the stationary stop (3*a*) and the displaceable stop (17*e*) and extends in the setting direction in the axially extending range of said breech member.

5. Setting tool according to claim 4, wherein the blocking device (19) is pivotally supported in the housing (1) and comprises an abutment shoulder (19*c*) for blocking the breech member (17).

6. Setting tool according to claim 5, wherein a spring element (22) is located within said housing (1) in contact with said blocking member for biasing the blocking device (19) into blocking engagement with said breech member (17).

7. Setting tool according to claim 6, wherein an actuation part (19*d*) on the blocking device (19) is spaced in the setting direction forwardly of the abutment shoulder (19*c*) for disengaging the blocking device from the breech member (17).

8. Setting tool according to claim 7, wherein the actuation part 19*d* includes a control surface cooperating with the barrel (11) for displacing the barrel (11) in the setting direction.

9. Setting tool according to claim 8, wherein a spring (12) located within and abutting against the housing (1) and barrel (11) is arranged to displace the barrel (11) in setting direction.

* * * * *